US010508862B2

(12) United States Patent
Joardar et al.

(10) Patent No.: US 10,508,862 B2
(45) Date of Patent: Dec. 17, 2019

(54) HEAT EXCHANGER FOR AIR-COOLED CHILLER

(71) Applicant: Carrier Corporation, Farmington, CT (US)

(72) Inventors: Arindom Joardar, Jamesville, NY (US); Michael F. Taras, Fayetteville, NY (US); Mel Woldesemayat, Liverpool, NY (US); Jack Leon Esformes, Jamesville, NY (US); Bruce J. Poplawski, Mattydale, NY (US); Tobias H. Sienel, Baldwinsville, NY (US); Jules Ricardo Munoz, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 14/776,877

(22) PCT Filed: Feb. 24, 2014

(86) PCT No.: PCT/US2014/018006

§ 371 (c)(1),
(2) Date: Sep. 15, 2015

(87) PCT Pub. No.: WO2014/149389

PCT Pub. Date: Sep. 25, 2014

(65) Prior Publication Data

US 2016/0033182 A1 Feb. 4, 2016

Related U.S. Application Data

(60) Provisional application No. 61/788,085, filed on Mar. 15, 2013.

(51) Int. Cl.
*F28D 1/04* (2006.01)
*F28D 1/02* (2006.01)
(Continued)

(52) U.S. Cl.
CPC ..... *F28D 1/0435* (2013.01); *F25B 39/04* (2013.01); *F28D 1/024* (2013.01); *F28D 1/05375* (2013.01); *F28D 1/05391* (2013.01)

(58) Field of Classification Search
CPC .. F25B 39/04; F28B 1/06; F28D 1/024; F28D 1/0435; F28D 1/05375; F28D 1/05391; F28D 2021/007; Y10T 29/4979
(Continued)

(56) References Cited

U.S. PATENT DOCUMENTS 3,092,470 A * 6/1963 Ripling ..... B21C 37/14 29/413
3,359,773 A * 12/1967 Stuchbery ..... B21D 11/08 29/413
(Continued)

FOREIGN PATENT DOCUMENTS

EP 1001241 A2 5/2000
EP 1298401 A2 4/2003
(Continued)

OTHER PUBLICATIONS

"Score" from Roget's 21st Century Thesaurus, Third Edition. 2013. Accessed via web <www.thesaurus.com> Mar. 2018.*
(Continued)

*Primary Examiner* — Jianying C Atkisson
*Assistant Examiner* — Tavia Sullens
(74) *Attorney, Agent, or Firm* — Cantor Colburn LLP

(57) ABSTRACT

An air-cooled chiller system includes a heat exchanger including a first tube bank including at least a first and a second flattened tube segments extending longitudinally in spaced parallel relationship; a second tube bank including at least a first and a second flattened tube segments extending longitudinally in spaced parallel relationship, the second tube bank disposed behind the first tube bank with a leading
(Continued)

edge of the second tube bank spaced from a trailing edge of the first tube bank; a fan creating an airflow across the first heat exchanger, the airflow flowing over the first tube bank prior to flowing over the second tube bank, wherein refrigerant flows in the heat exchanger in a cross-counterflow direction opposite that of the airflow direction.

26 Claims, 7 Drawing Sheets

(51) Int. Cl.

| | |
|---|---|
| ***F28D 1/053*** | (2006.01) |
| ***F28D 1/06*** | (2006.01) |
| ***F28D 21/00*** | (2006.01) |
| ***F25B 39/04*** | (2006.01) |

(58) Field of Classification Search
USPC ..... 62/507; 165/135, 140, 145; 428/43; 138/38, 106
See application file for complete search history.

(56) References Cited

U.S. PATENT DOCUMENTS

| | | | | |
|---|---|---|---|---|
| 3,658,206 | A * | 4/1972 | Barbier | F16K 17/162 220/89.2 |
| 3,731,497 | A * | 5/1973 | Ewing | F25B 13/00 62/160 |
| 4,289,169 | A * | 9/1981 | Banholzer | F01N 13/10 138/37 |
| 4,289,170 | A * | 9/1981 | Pape | F01N 13/08 138/37 |
| 4,550,777 | A * | 11/1985 | Fournier | F22B 37/202 122/510 |
| 4,683,101 | A | 7/1987 | Cates | |
| 5,765,393 | A | 6/1998 | Shlak et al. | |
| 5,941,303 | A | 8/1999 | Gowan | |
| 6,217,222 | B1 * | 4/2001 | Mattson | F16C 23/046 29/413 |
| 6,244,330 | B1 * | 6/2001 | Eisinger | F22B 37/202 122/510 |
| 6,662,858 | B2 | 12/2003 | Wang | |
| 6,688,377 | B2 | 2/2004 | Wang | |
| 6,732,789 | B2 | 5/2004 | Jang | |
| 7,793,708 | B2 * | 9/2010 | Wanni | F28F 9/0132 165/162 |
| 7,905,277 | B2 * | 3/2011 | Riondet | B21D 53/085 165/135 |
| 2003/0188857 | A1 * | 10/2003 | Kawakubo | F28D 1/0476 165/174 |
| 2005/0006069 | A1 * | 1/2005 | Kamiyama | F28D 1/0443 165/140 |
| 2005/0172664 | A1 * | 8/2005 | Cho | F28D 1/05391 62/515 |
| 2005/0279487 | A1 * | 12/2005 | Wanni | F28F 9/0132 165/162 |
| 2008/0093051 | A1 * | 4/2008 | Rios | F25B 41/067 165/61 |
| 2009/0025914 | A1 * | 1/2009 | Knight | F25B 39/00 165/144 |
| 2011/0232884 | A1 | 9/2011 | Jiang et al. | |
| 2012/0279689 | A1 | 11/2012 | Wang et al. | |
| 2013/0067912 | A1 * | 3/2013 | Eilemann | F02B 29/0412 165/81 |

FOREIGN PATENT DOCUMENTS

| | | | |
|---|---|---|---|
| EP | 1757869 | A2 | 2/2007 |
| JP | H07208822 | A | 8/1995 |
| JP | 2004108601 | A | 4/2004 |
| JP | 2005265263 | A | 9/2005 |
| JP | 2010107103 | A | 5/2010 |
| JP | 2011127785 | A | 6/2011 |
| WO | 2011156700 | A2 | 12/2011 |
| WO | 2012027098 | A2 | 3/2012 |
| WO | 2012071196 | A2 | 5/2012 |

OTHER PUBLICATIONS

International Search Report for application PCT/US2014/018006, dated Jun. 5, 2014, 4 pages.
Written Opinion for application PCT/US2014/018006, dated Jun. 5, 2014, 4 pages.
Second Chinese Office Action and Search Report for application CN 201480027548.3, dated Jul. 17, 2017, 9pgs.

* cited by examiner

HEAT EXCHANGER FOR AIR-COOLED CHILLER

BACKGROUND

This invention relates generally to heat exchangers and, more particularly, to multiple tube bank heat exchanger for use in an air-cooled chiller.

In a conventional air conditioning system, the condenser of the refrigeration circuit is located exterior to a building. Typically, the condenser includes a condensing heat exchanger and a fan for circulating a cooling medium (e.g., air) over the condensing heat exchanger. The air conditioning system further includes an indoor unit having an evaporator for transferring heat energy from the indoor air to be conditioned to the refrigerant flowing through the evaporator and a fan for circulating the indoor air in a heat exchange relationship with the evaporator.

Air-cooled condensers, including air-cooled chillers and rooftops, are often used for applications requiring large capacity cooling and heating. Because larger condenser heat exchanger surfaces are needed for the functionality of the system, the condenser generally includes a plurality of condensers units. Multiple fans are located on top of the condenser housing for each unit.

Historically, these heat exchangers in condensers have been round tube and plate fin (RTPF) heat exchangers. However, all aluminum flattened tube serpentine fin heat exchangers are finding increasingly wider use in industry, including the heating, ventilation, air condition and refrigeration (HVACR) industry, due to their compactness, thermal-hydraulic performance, structural rigidity, lower weight and reduced refrigerant charge, in comparison to conventional RTPF heat exchangers. Flattened tubes commonly used in HVACR applications typically have an interior subdivided into a plurality of parallel flow channels. Such flattened tubes are commonly referred to in the art as multi-channel tubes, mini-channel tubes or micro-channel tubes.

A typical flattened tube serpentine fin heat exchanger includes a first manifold, a second manifold, and a single tube bank formed of a plurality of longitudinally extending flattened heat exchange tubes disposed in spaced parallel relationship and extending between the first manifold and the second manifold. The first manifold, second manifold and tube bank assembly is commonly referred to in the heat exchanger art as a slab. Additionally, a plurality of fins are disposed between the neighboring pairs of heat exchange tubes for increasing heat transfer between a fluid, commonly air in HVACR applications, flowing over the outside surfaces of the flattened tubes and along the fin surfaces and a fluid, commonly refrigerant in HVACR applications, flowing inside the flattened tubes. Such single tube bank heat exchangers, also known as single slab heat exchangers, have a pure cross-flow configuration.

Double bank flattened tube and serpentine fin heat exchangers are also known in the art. Conventional double bank flattened tube and serpentine fin heat exchangers are typically formed of two conventional fin and tube slabs, one positioned behind the other, with fluid communication between the manifolds accomplished through external piping. However, to connect the two slabs in fluid flow communication in other than a parallel cross-flow arrangement requires complex external piping and precise heat exchanger slab alignment. For example, U.S. Pat. No. 6,964,296 B2 and U.S. Patent Application Publication 2009/0025914 A1 disclose embodiments of double bank, multichannel flattened tube heat exchanger.

SUMMARY OF THE INVENTION

An embodiment includes an air-cooled chiller system includes a heat exchanger including a first tube bank including at least a first and a second flattened tube segments extending longitudinally in spaced parallel relationship; a second tube bank including at least a first and a second flattened tube segments extending longitudinally in spaced parallel relationship, the second tube bank disposed behind the first tube bank with a leading edge of the second tube bank spaced from a trailing edge of the first tube bank; a fan creating an airflow across the heat exchanger, the airflow flowing over the first tube bank prior to flowing over the second tube bank, wherein refrigerant flows in the heat exchanger in a cross-counterflow direction opposite that of the airflow direction.

BRIEF DESCRIPTION OF THE DRAWINGS

For further understanding of the disclosure, reference will be made to the following detailed description which is to be read in connection with the accompanying drawing, where.

DETAILED DESCRIPTION

Figure 1:
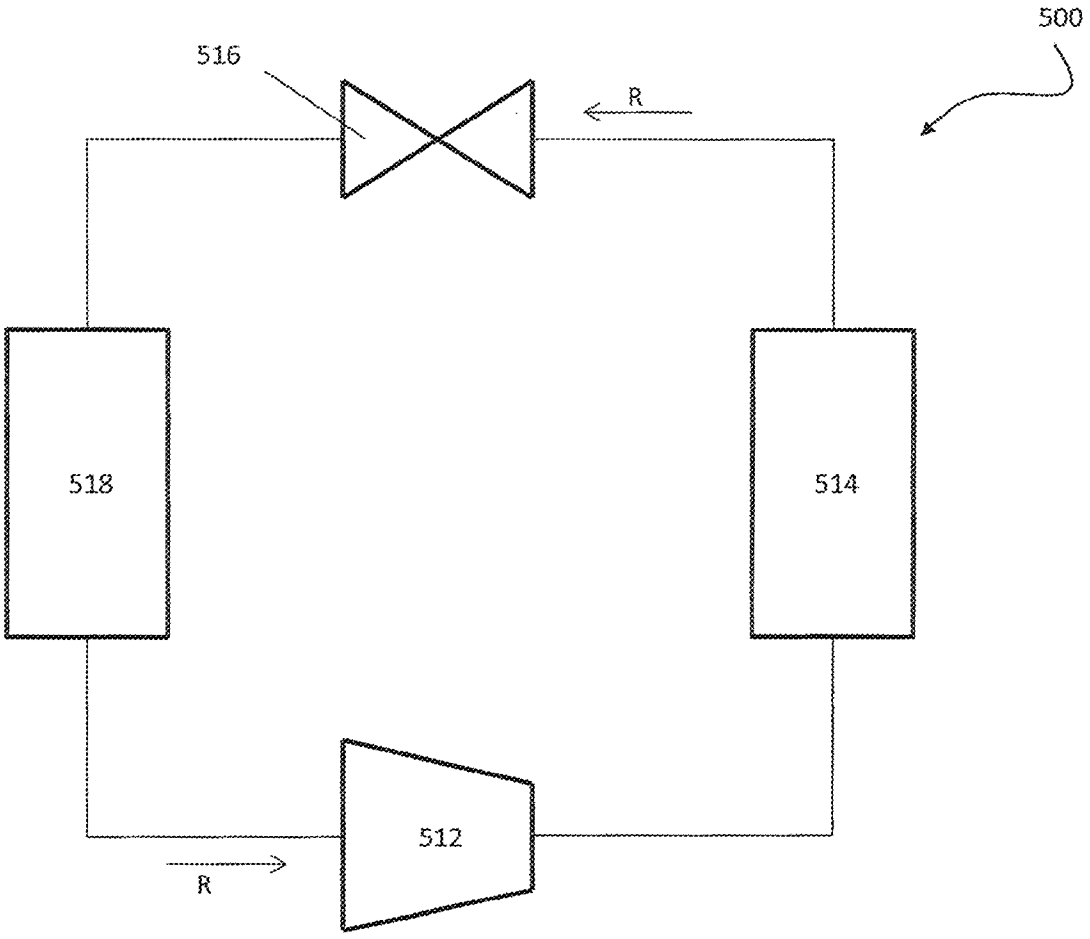
FIG. 1 depicts a vapor-compression cycle of an air conditioning system in an exemplary embodiment.

Referring now to FIG. I, a vapor compression or refrigeration cycle 500 of an air conditioning system is schematically illustrated. Exemplary air conditioning systems include split, packaged, chiller and rooftop systems, for example. A refrigerant R is configured to circulate through the vapor compression cycle 500 such that the refrigerant R absorbs heat when evaporated at a low temperature and pressure and releases heat when condensing at a higher temperature and pressure. Within this cycle 500, the refrigerant R flows in a counterclockwise direction as indicated by the arrows. The compressor 512 receives refrigerant vapor from the evaporator 518 and compresses it to a higher temperature and pressure, with the relatively hot vapor then passing to the condenser 514 where it is cooled and condensed to a liquid state by a heat exchange relationship with a cooling medium such as air or water. The liquid refrigerant R then passes from the condenser 514 to an expansion device 516, wherein the refrigerant R is expanded to a low temperature two-phase liquid/vapor state as it passes to the evaporator 518. The low pressure vapor then returns to the compressor 512 where the cycle is repeated. It has to be understood that the refrigeration cycle 500 depicted in FIG. 1 is a simplistic representation of the HVAC&R system, and many enhancements and features known in the art may be included in the schematic. Furthermore, the refrigeration cycle 500 may operate in the super-critical region, where the high pressure refrigerant state is above the critical point and is represented by a single-phase medium.

Figure 2:
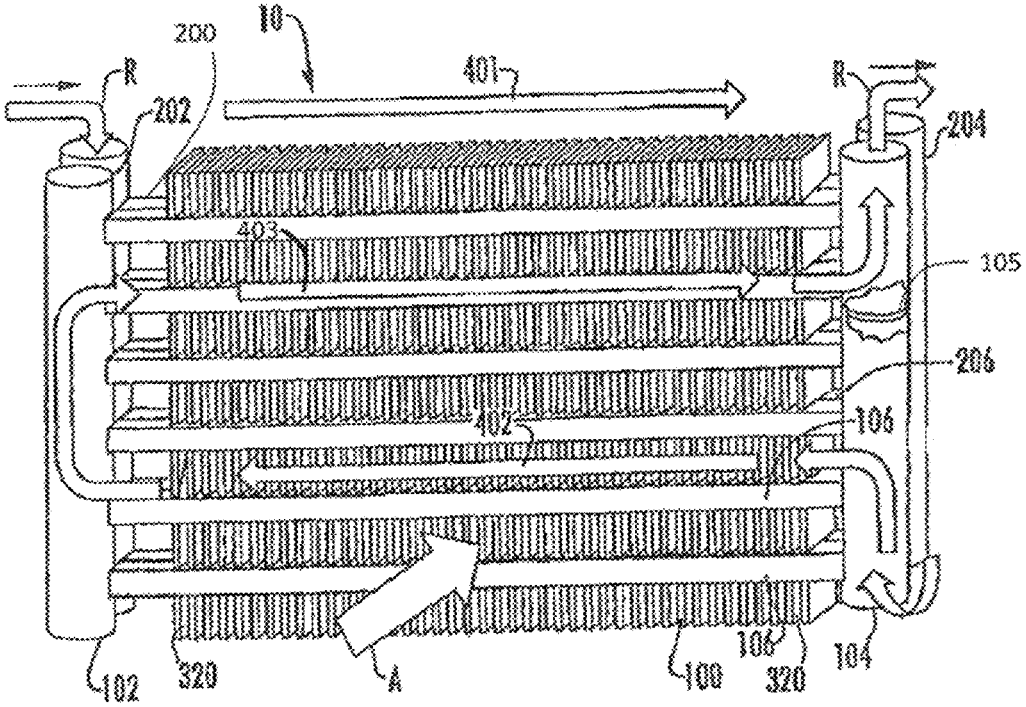
FIG. 2 depicts a multiple tube bank, flattened tube finned heat exchanger in an exemplary embodiment.

FIG. 2 is a perspective view of a multiple bank flattened tube finned heat exchanger, generally designated 10, in an exemplary embodiment. As depicted therein, the multiple bank flattened tube finned heat exchanger 10 includes a first tube bank 100 and a second tube bank 200 that is disposed behind the first tube bank 100, that is downstream with respect to air flow, A, through the heat exchanger 10. The first tube bank 100 may also be referred to herein as the front heat exchanger slab 100 and the second tube bank 200 may also be referred to herein as the rear heat exchanger slab 200.

The first tube bank 100 includes a first manifold 102, a second manifold 104 spaced apart from the first manifold 102, and a plurality of heat exchange tube segments 106, including at least a first and a second tube segment, extending longitudinally in spaced parallel relationship between and connecting the first manifold 102 and the second manifold 104 in fluid communication. The second tube bank 200 includes a first manifold 202, a second manifold 204 spaced apart from the first manifold 202, and a plurality of heat exchange tube segments 206, including at least a first and a second tube segment, extending longitudinally in spaced parallel relationship between and connecting the first manifold 202 and the second manifold 204 in fluid communication. Each set of manifolds 102, 202 and 104, 204 disposed at either side of the dual bank heat exchanger 10 may comprise separate paired manifolds, may comprise separate chambers within an integral one-piece folded manifold assembly or may comprise separate chambers within an integral fabricated (e.g. extruded, drawn, rolled and welded) manifold assembly. Each tube bank 100, 200 may further include guard or "dummy" tubes (not shown) extending between its first and second manifolds at the top of the tube bank and at the bottom of the tube bank. These "dummy" tubes do not convey refrigerant flow, but add structural support to the tube bank and protect the uppermost and lowermost fins.

Figure 3:
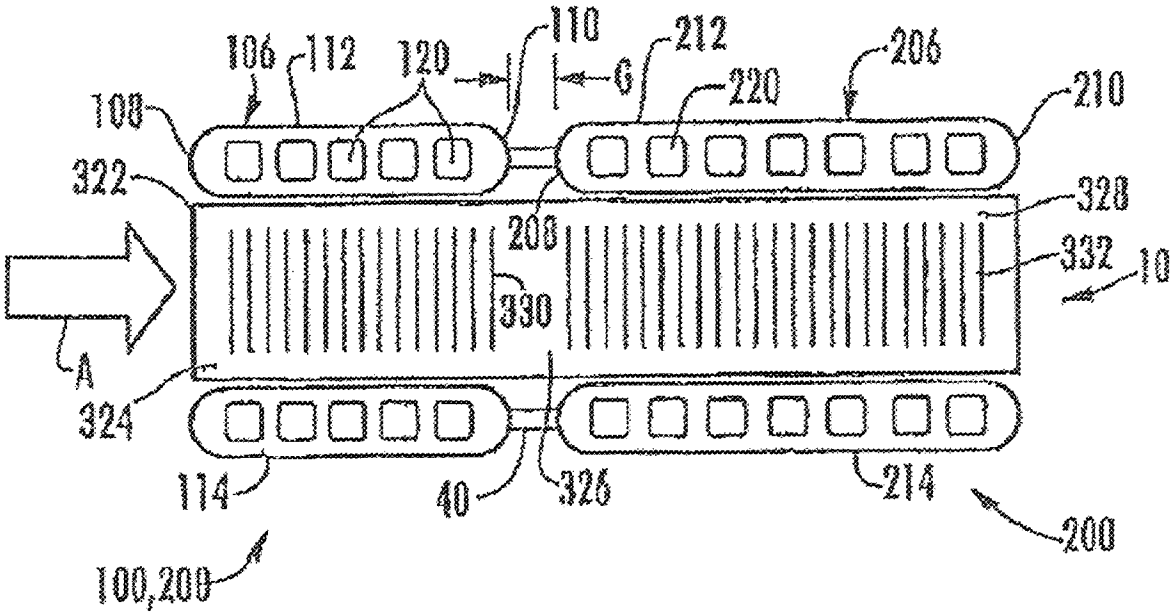
FIG. 3 is a side elevation view, partly in section, illustrating a fin and a set of integral flattened tube segment assemblies of the heat exchanger of FIG. 2.

Referring now to FIG. 3, each of the heat exchange tube segments 106, 206 comprises a flattened heat exchange tube having a leading edge 108, 208, a trailing edge 110, 210, an upper surface 112, 212, and a lower surface 114, 214. The leading edge 108, 208 of each heat exchange tube segment 106, 206 is upstream of its respective trailing edge 110, 210 with respect to airflow through the heat exchanger 10. In the embodiment depicted in FIG. 3, the respective leading and trailing portions of the flattened tube segments 106, 206 are rounded thereby providing blunt leading edges 108, 208 and trailing edges 110, 210. However, it is to be understood that the respective leading and trailing portions of the flattened tube segments 106, 206 may be formed in other configurations.

The interior flow passage of each of the heat exchange tube segments 106, 206 of the first and second tube banks 100, 200, respectively, may be divided by interior walls into a plurality of discrete flow channels 120, 220 that extend longitudinally the length of the tube from an inlet end of the tube to an outlet end of the tube and establish fluid communication between the respective headers of the first and the second tube banks 100, 200. In the embodiment of the multi-channel heat exchange tube segments 106, 206 depicted in FIG. 3, the heat exchange tube segments 206 of the second tube bank 200 have a greater width than the heat exchange tube segments 106 of the first tube bank 100. Also, the interior flow passages of the wider heat exchange tube segments 206 may be divided into a greater number of discrete flow channels 220 than the number of discrete flow channels 120 into which the interior flow passages of the heat exchange tube segments 106 are divided. The flow channels 120, 220 may have a circular cross-section, a rectangular cross-section or other non-circular cross-section.

The second tube bank 200, i.e. the rear heat exchanger slab, is disposed behind the first tube bank 100, i.e. the front heat exchanger slab, with respect to the airflow direction, with each heat exchange tube segment 106 directly aligned with a respective heat exchange tube segment 206 and with the leading edges 208 of the heat exchange tube segments 206 of the second tube bank 200 spaced from the trailing edges 110 of the heat exchange tube segments of the first tube bank 100 by a desired spacing, G. A spacer or a plurality of spacers disposed at longitudinally spaced intervals may be provided between the trailing edges 110 of the heat exchange tube segments 106 and the leading edges 208 of the heat exchange tube segments 206 to maintain the desired spacing, G, during brazing of the preassembled heat exchanger 10 in a brazing furnace.

In the embodiment depicted in FIG. 3, an elongated web 40 or a plurality of spaced web members 40 span the desired spacing gap, G, along at least of portion of the length of each aligned set of heat exchange tube segments 106, 206. For a further description of a dual bank, flattened tube finned heat exchanger wherein the heat exchange tubes 106 of the first tube bank 100 and the heat exchange tubes 206 of the second tube bank 200 are connected by an elongated web or a plurality of web members, reference is made to U.S. provisional application Ser. No. 61/593,979, filed Feb. 2, 2012, the entire disclosure of which is hereby incorporated herein by reference.

Referring still to FIGS. 2 and 3, the flattened tube finned heat exchanger 10 disclosed herein further includes a plurality of folded fins 320. Each folded fin 320 is formed of a single continuous strip of fin material tightly folded in a ribbon-like serpentine fashion thereby providing a plurality of closely spaced fins 322 that extend generally orthogonal to the flattened heat exchange tubes 106, 206. Typically, the fin density of the closely spaced fins 322 of each continuous folded fin 320 may be about 16 to 25 fins per inch, but higher or lower fin densities may also be used. Heat exchange between the refrigerant flow, R, and air flow, A, occurs through the outside surfaces 112, 114 and 212, 214, respectively, of the heat exchange tube segments 106, 206, collectively forming the primary heat exchange surface, and also through the heat exchange surface of the fins 322 of the folded fin 320, which forms the secondary heat exchange surface.

In the depicted embodiment, the depth of each of the ribbon-like folded fin 320 extends at least from the leading edge 108 of the first tube bank 100 to the trailing edge of 210 of the second bank 200, and may overhang the leading edge 108 of the first tube bank 100 or/and trailing edge 208 of the second tube bank 200 as desired. Thus, when a folded fin 320 is installed between a set of adjacent multiple tube, flattened heat exchange tube assemblies 240 in the array of tube assemblies of the assembled heat exchanger 10, a first section 324 of each fin 322 is disposed within the first tube bank 100, a second section 326 of each fin 322 spans the spacing, G, between the trailing edge 110 of the first tube bank 100 and the leading edge 208 of the second tube bank 200, and a third section 328 of each fin 322 is disposed within the second tube bank 200. In an embodiment, each fin 322 of the folded fin 320 may be provided with louvers 330, 332 formed in the first and third sections, respectively, of each fin 322.

The multiple bank, flattened tube heat exchanger 10 disclosed herein is depicted in a cross-counterflow arrangement wherein refrigerant (labeled "R") from a refrigerant circuit of a refrigerant vapor compression system (such as that of FIG. 1) passes through the manifolds and heat exchange tube segments of the tube banks 100, 200, in a manner to be described in further detail hereinafter, in heat exchange relationship with a cooling media, most commonly ambient air, flowing through the airside of the heat exchanger 10 in the direction indicated by the arrow labeled "A" that passes over the outside surfaces of the heat exchange tube segments 106, 206 and the surfaces of the folded fin strips 320. The air flow first passes transversely across the upper and lower horizontal surfaces 112, 114 of the heat exchange tube segments 106 of the first tube bank, and then passes transversely across the upper and lower horizontal surfaces 212, 214 of the heat exchange tube segments 206 of the second tube bank 200. The refrigerant passes in cross-counterflow arrangement to the airflow, in that the refrigerant flow passes first through the second tube bank 200 and then through the first tube bank 100. The multiple tube bank, flattened tube finned heat exchanger 10 having a cross-counterflow circuit arrangement yields superior heat exchange performance, as compared to the crossflow or cross-parallel flow circuit arrangements, as well as allows for flexibility to manage the refrigerant side pressure drop via implementation of tubes of various widths within the first tube bank 100 and the second tube bank 200.

In the embodiment depicted in FIGS. 2 and 3, the second tube bank 200, i.e. the rear heat exchanger slab with respect to air flow, has a first, single-pass refrigerant circuit 401 configuration and the first tube bank 100, i.e. the front heat exchanger slab with respect to air flow, has a two pass configuration with passes 402 and 403. Refrigerant flow passes from a refrigerant circuit into the first manifold 202 of the second tube bank 200 through at least one refrigerant inlet, passes through the heat exchange tube segments 206 into the second manifold 204 of the second tube bank 200, then passes into the second manifold 104 of the first tube bank 100, thence through a lower set of the heat exchange segments 106 into the first manifold 102 of the first tube bank 100, thence back to the second manifold 104 through an upper set of the heat exchange tubes 106, and thence passes back to the refrigerant circuit through at least one refrigerant outlet 122. A separator 105 divides the second manifold 104 of the first tube bank 100 into two chambers.

In the embodiments depicted in FIGS. 2 and 3, the neighboring second manifolds 104 and 204 are connected in fluid flow communication such that refrigerant may flow from the interior of the second manifold 204 of the second tube bank 200 into the interior of the second manifold 104 of the first tube bank 100. In the embodiment depicted in FIG. 3, the first tube bank 100 and second tube bank 200 may be brazed together to form an integral unit with a single fin 326 spanning both tube banks that facilitates handling and installation of heat exchanger 10. However the first tube bank 100 and second tube bank 200 may be assembled as separate slabs and then brazed together as a composite heat exchanger. The embodiment of FIG. 3 depicts heat exchange tube segments 106 aligned with heat exchange tube segments 206. It is understood that in other embodiments, heat exchange tube segments 106 may be offset or staggered with respect to heat exchange tube segments 206.

Figure 4:
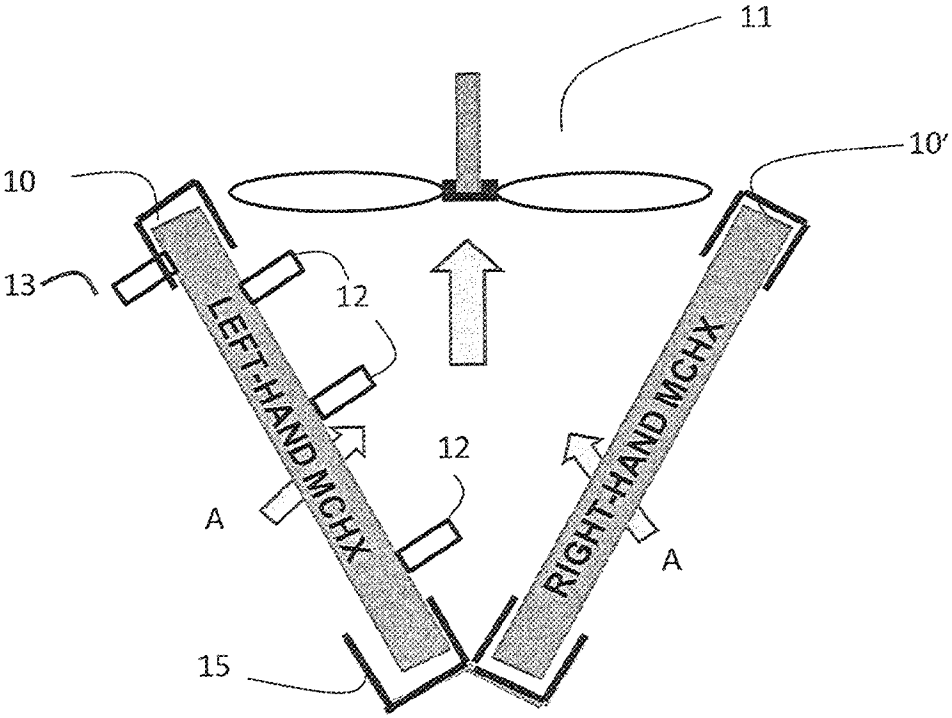
FIG. 4 depicts heat exchangers of FIG. 2 mounted in a V-orientation.

The multiple bank flattened tube finned heat exchanger 10 provides improved refrigerant circuiting when used, for example, in a chiller. FIG. 4 depicts two multiple bank flattened tube finned heat exchangers 10 and 10' arranged in a V configuration, typical of rooftop condenser. A fan 11 draws air through heat exchangers 10 and 10'. Typical air-cooled chillers employ single slab heat exchangers. The conventional single slab heat exchangers employ pure crossflow circuiting with air flowing in a vertical plane and generally perpendicular to the refrigerant flow. The multiple bank flattened tube finned heat exchanger 10 employs cross-counterflow refrigerant circuiting wherein the air is flowing in the direction generally opposite to the refrigerant. The cross-counterflow circuiting is thermodynamically more efficient for the heat transfer due to overall higher driving potential that could be achieved. The conventional heat exchangers widely in use today are symmetric in terms of air inlet or outlet faces, which is a result of the pure crossflow refrigerant circuiting. The multiple bank flattened tube finned heat exchangers 10 and 10', when installed in a V module, have a left and a right hand design distinction, which is a consequence of the cross-counterflow arrangement. Therefore the two multiple bank flattened tube finned heat exchanger 10 and 10' as installed in a V module are mirror images of each other as shown in FIG. 4.

The conventional single slab heat exchangers are typically limited to two crossflow passes of refrigerant across the flow length between the two heat exchanger headers, typically due to the pressure drop limitation-. The multiple bank flattened tube finned heat exchanger 10 provides three refrigerant passes shown in FIG. 2 as a first pass 401, second pass 402 and third pass 403. First pass 401 occupies the second tube bank 200, which corresponds to about 50% of the total heat exchange area of heat exchanger 10. The first refrigerant pass 401 is dedicated for desuperheating and initial condensing. In air-cooled chiller applications, the refrigerant quality in the manifold 204 should remain relatively high, about 0.6-0.8. This allows for uniform refrigerant distribution, since the refrigerant composition contains predominantly single phase vapor that flows into the second pass 402. The second pass 402 occupy no more than about 40% and no less than about 30% of the total heat exchange area of heat exchanger 10. After the second pass 402, the refrigerant quality should be very low and no more than about 0.2-0.4, once again allowing for uniform refrigerant distribution, since the refrigerant composition contains predominantly single phase liquid that flows into the third pass 403. The third pass 403 should be about 10% to about 20% of the total heat exchange area of heat exchanger 10. Third pass 403 provides a subcooling circuit. The location of the subcooling circuit is preferably positioned in the highest airflow region, typically closer to fan 11. Conversely, if other limitations are imposed on the heat exchanger, such as self-draining refrigerant requirement for the so-called "free-cooling" feature in the air-cooled chiller applications, the subcooling circuit may be positioned at the bottom of the heat exchanger 10.

Figure 5:
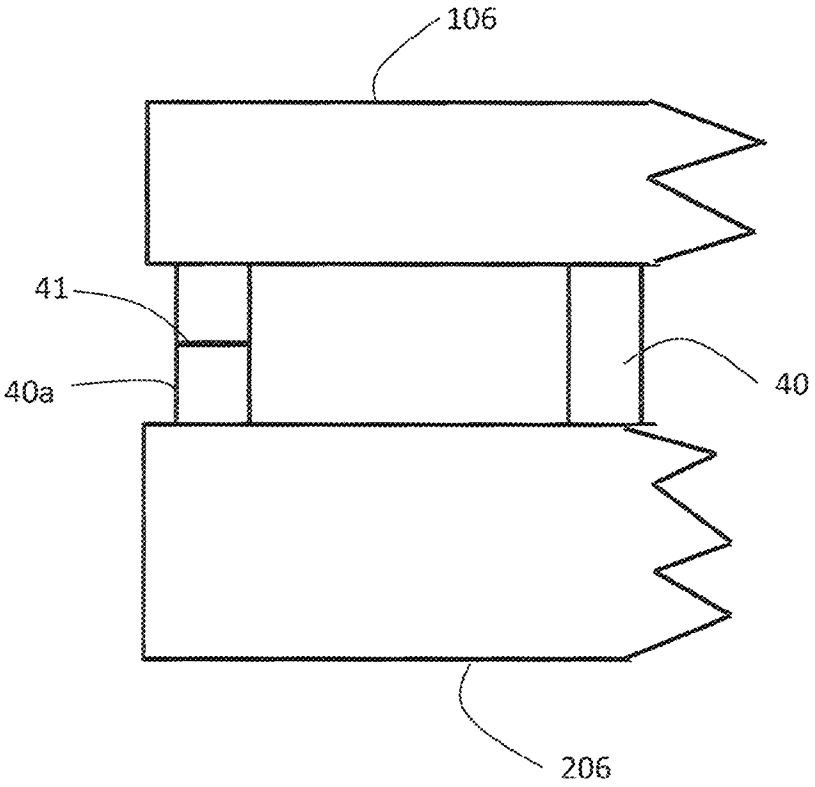
FIG. 5 depicts flattened tube segments and a web in an exemplary embodiment.

Thermal mechanical fatigue is a known phenomenon in air-cooled chiller applications. FIG. 5 depicts an embodiment to reduce or eliminate the possibility of thermal mechanical fatigue. Shown in FIG. 5 is a portion of heat exchanger tube segment 106, a portion of heat exchanger tube segment 206, and webs 40 joining heat exchanger tube segments 106 and 206. Folded fins 320 are not shown for ease of illustration. Web 40*a* closest to a distal end of heat exchanger tube segments 106 and 206 is scored at score line 41 to weaken web 40*a*. A web at the opposite distal end of tube segments 106 and 206 may also be scored. Scoring web 40 provides a path of least resistance for crack propagation due to different thermal expansion of various components of heat exchanger 10. Therefore, a crack will not be initiated at the locations that are critical for the heat exchanger functionality such as tube-to-manifold joint, which is a typical thermal mechanical fatigue crack initiation site. The score line 41 may extend the entire width of the web 40*a* or just a portion of the web 40*a*.

Embodiments include dimensional relationships among components of the heat exchanger 10. In an exemplary embodiment, the gap, G, (FIG. 3) is about 15% to about 25% of the overall tube segment depth, that is, the distance from leading edge 108 of tube segment 106 to the trailing edge 210 of tube segment 206. This spacing may be used if the heat exchanger 10 uses individual tubes or integral tube segments joined by web 40. While using integrally formed tubes 106, 206, the web 40 may be slotted along its length. In an exemplary embodiment, slots in web 40 are about 90% to about 95% of the total tube segment length to provide enhanced water drainage and minimal cross-conduction while maintaining manufacturing integrity. In other words, webs 40 take up about 5% to about 10% of the space in gap G along the total tube segment length. In an exemplary embodiment, an individual tube segment 106, 206 width is about 30% to about 50% heat exchanger core depth. In an exemplary embodiment, manifold outer diameter (OD) range is about 1.4 to about 2.2 times the tube segment width (e.g., from leading edge to trailing edge) in air-cooled chiller applications. In an exemplary embodiment, the fin density of folded fin 320 air-cooled chiller application is from about 19 to about 22 fins per inch. In an exemplary embodiment, the range of fin height to tube segment pitch ratio is about 0.45 to about 1.4. Tube segment pitch is spacing between flattened tube segments in the first tube bank, or spacing between flattened tube segments the second tube bank. In an exemplary air-cooled chiller applications, the tube segment width is about 10 mm to about 16 mm, the tube segment height is about 1.6 mm to about 2.2 mm, the tube segment port size is about 0.8 mm to about 1.2 mm, the fin height is about 7.8 mm to about 8.2 mm, the fin thickness is about 0.07 mm to about 0.09 mm, the number of louvers is about 9 to about 11 per bank (while typically having 2 banks per tube), the louver height is from about 80% to about 95% of the fin height, the manifold diameter is about 18 mm to 22 mm, the gap between the inlet headers is about 2 mm to about 3 mm, the manifold slots offset is about 2 mm to about 3 mm, and the number of slabs is about 2 to about 4.

Embodiments include improved routing of refrigerant to and from heat exchanger 10. The current practice of using conventional heat exchangers in air-cooled chillers is to have the inlet and outlet piping at the same side on the same manifold. The hot incoming refrigerant is separated by the cold outgoing refrigerant by a separator plate across which there is a large thermal gradient. This is detrimental from a thermal-mechanical-fatigue perspective and a thermal performance (cross-conduction) point of view. In embodiments of the invention, the inlet and outlet connection pipes are positioned on different manifolds resolving the two issues outlined hereabove. For example, as shown in FIG. 1, inlet manifold 202 is at an opposite end of heat exchanger 10 from outlet manifold 104. In exemplary embodiments, heat exchanger 10 includes three inlet pipes compared to two for the conventional heat exchangers. This results in more uniform refrigerant distribution, lower pressure drop penalty and lower susceptibility to thermal-mechanical-fatigue (due to more uniform manifold expansion). In exemplary embodiments, refrigerant inlet pipes are appropriately spaced and positioned on the back slab towards the interior of the 'V' module. Exemplary inlet pipes 12 for heat exchanger 10 are depicted in FIG. 4. The heat exchanger outlet pipe is typically positioned on the front slab toward the exterior of the 'V' module. Exemplary outlet pipe 13 for heat exchanger 10 is depicted in FIG. 4. This arrangement allows for better optimization of refrigerant piping length with respect to adjacent components such as compressors and coolers. A frame 15 may be used to protect heat exchanger 10 from handling damage and galvanic corrosion as well as for ease of installation. Frame 15 may be a C-shaped channel that surrounds the outer edges of heat exchanger 10. The frame may include rubber grommets and installation pads positioned between the frame 15 and the heat exchanger 10 to accommodate the heat exchanger 10 core and dual manifold configuration.

Figure 6:
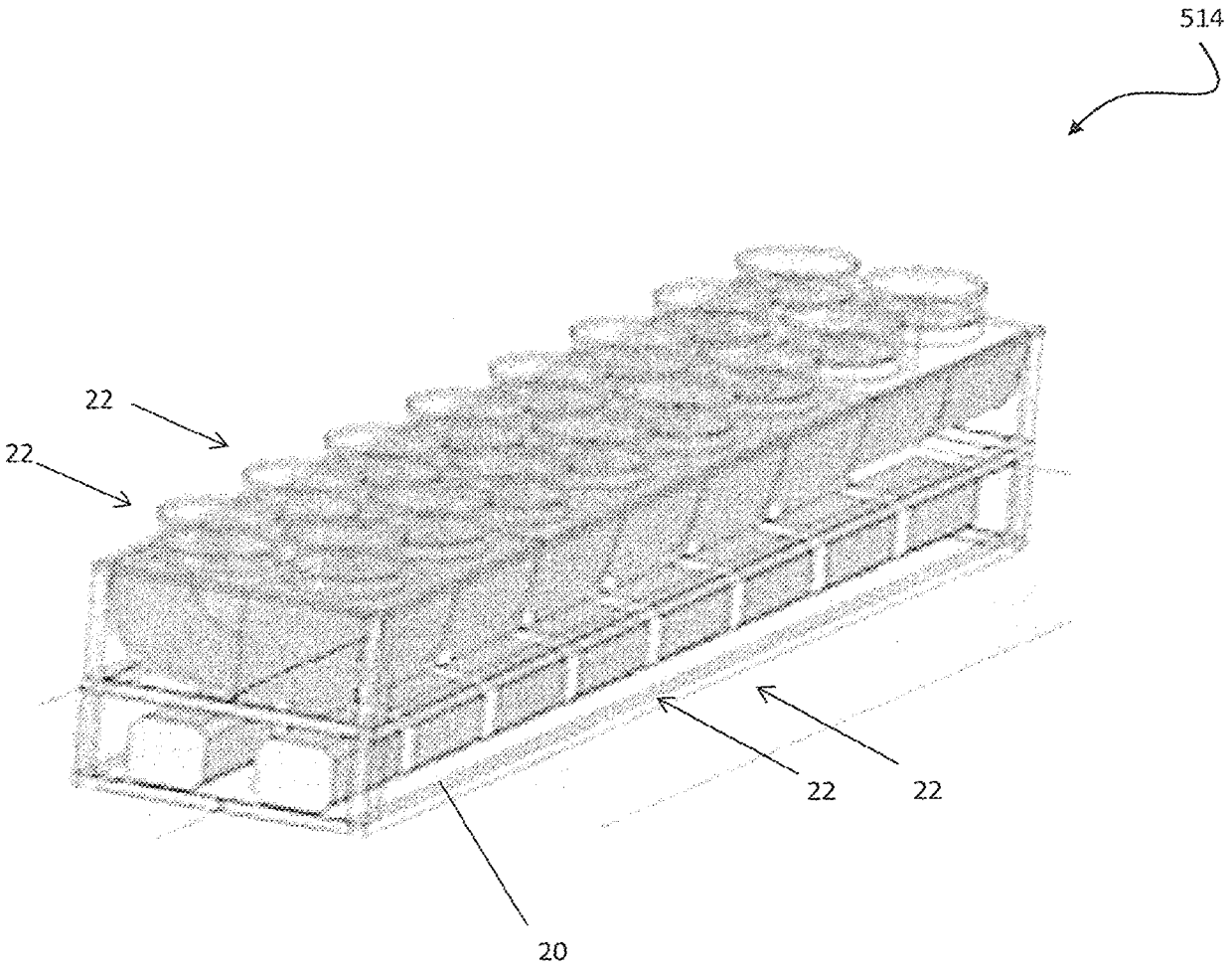
FIG. 6 is a perspective view of a condenser in an exemplary embodiment.
Figure 7:
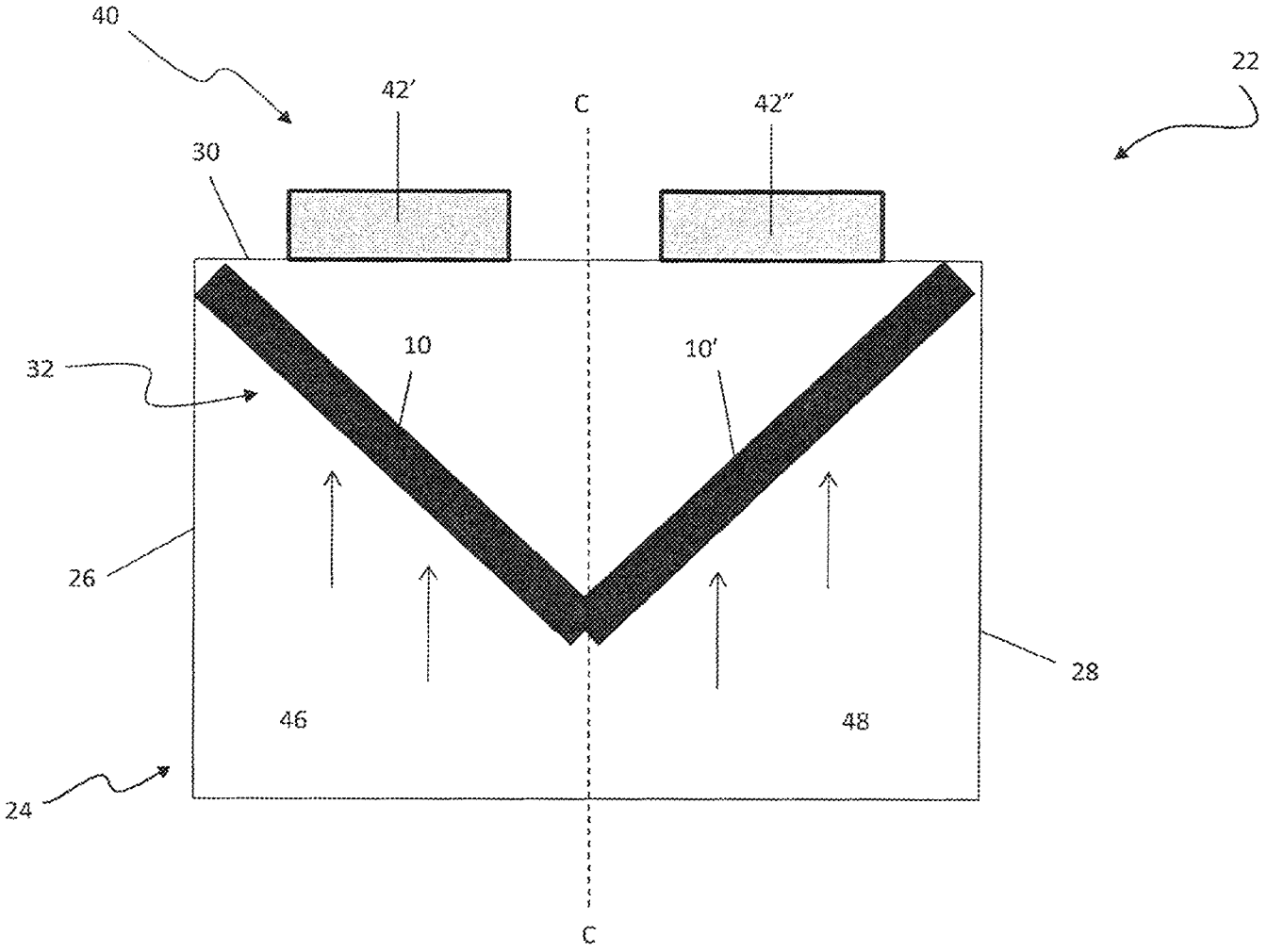
FIG. 7 is a front view, partly in section, of a condenser module in an exemplary embodiment.

In addition to the V module of FIG. 4, heat exchanger 10 may be employed in a modular condenser configuration. Referring now to FIGS. 6 and 7, an air-cooled condenser 514, such as used in the vapor compression cycle 500 of FIG. 1, is illustrated in more detail. As shown in FIG. 6, the condenser 514 includes one or more identical condenser modules 22 positioned within a support 20, such as the type of support 20 normally found on building rooftops for example. Any number of condenser modules 22 may be installed within the support 20 to form a condenser 514 configured to meet the capacity and cooling requirements for a given application. Referring now to the exemplary condenser module 22 illustrated in FIG. 7, the condenser module 22 includes a housing or cabinet 24 configured to be received within the support 20. Opposing lateral sides 26, 28 of the housing 24 each define an inlet for air to flow into the module 22. Similarly, a first end 30 of the housing 24, connected to both of the opposing lateral sides 26, 28, defines an outlet opening for air to exit from the condenser module 22. In one embodiment, the condenser modules 22 are positioned within the support 20 such that at least one of an opposing front surface and back surface of the housing 24 is arranged adjacent to either a front surface or a back surface of the housing 24 of another condenser module 22 (see FIG. 6).

Located within the housing 24 of the condenser module 22 is a heat exchanger assembly 32 arranged generally longitudinally between the lateral sides 26, 28. The cross-section of the heat exchanger assembly 32 is generally constant over a length of the condenser module 22, such as between the front surface and the back surface. The heat exchanger assembly 32 includes at least one heat exchanger 10, such as that shown in FIG. 2. A plurality of heat exchangers 10, 10' of the heat exchanger assembly 32 may be arranged generally symmetrically about a center of the condenser module 22 between the opposing lateral sides 26, 28, as illustrated schematically by line C. In the illustrated, non-limiting embodiment, the heat exchanger assembly 32 includes a first heat exchanger 10 mounted to the first lateral side 26 of the housing 24 and a second, substantially identical heat exchanger 10' mounted to the second lateral side 28 of the housing 24. The plurality of heat exchangers 10, 10' may be arranged within the housing 24 such that the heat exchanger assembly 32 has a generally V-shaped configuration, as shown in FIG. 4. Alternative configurations of the heat exchanger assembly 32, such as the generally U-shaped configuration illustrated in FIG. 6 for example, are also within the scope of the invention. In other embodiments, heat exchangers 10, 10' are arranged in V-shaped configuration, but rotated relative to the orientation shown in FIG. 7. That is, an axis corresponding to an apex of the V shape may be parallel to a longitudinal axis of the housing 24. Alternatively, heat exchangers 10, 10' may be positioned so that the axis corresponding to an apex of the V shape is perpendicular to the longitudinal axis of the housing 24.

The airflow for the multi-slab microchannel heat exchangers in air-cooled chiller applications is required to be between about 300 feet per minute and about 700 feet per minute, for optimal performance. More precisely, the airflow should be in the range between about 400 feet per minute and about 500 feet per minute. The refrigerant flow rate per multi-slab microchannel heat exchanger in a typical V module for air-cooled applications should be between about 2500 pounds per hour to about 4500 pounds per hour. Furthermore, the inventive heat exchanger design is optimal for and can be used with the high pressure refrigerants such as R410A and low pressure refrigerants such as R134a.

The condenser module 22 additionally includes a fan assembly 40 configured to circulate air through the housing 24 and the heat exchanger assembly 32. Depending on the characteristics of the condenser module 22, the fan assembly 40 may be positioned either downstream with respect to the heat exchanger assembly 32 (i.e. "draw through configuration") as shown in the FIG. 7, or upstream with respect to the heat exchanger assembly 32 (i.e. "blow through configuration").

In one embodiment, the fan assembly 40 is mounted at the first end 30 of the housing 24 in a draw-through configuration. The fan assembly 40 generally includes a plurality of fans 42 such that the number of fans 42 configured to draw air through each of the respective heat exchangers 10 is identical. In one embodiment, the plurality of fans 42 in the fan assembly 40 substantially equals the plurality of heat exchangers 10 in the heat exchanger assembly 32. In addition, the at least one fan 42 configured to draw air through a single heat exchanger 10 is generally vertically aligned with that respective heat exchanger 10 such that the plurality of fans 42 in the fan assembly 40 are substantially symmetrical about center line C. For example, in embodiments where the heat exchanger assembly 32 includes a first heat exchanger 10 and second heat exchanger coil 10', at least a first fan 42' is generally aligned with the first heat exchanger 10 and at least a second fan 42" is generally aligned with the second heat exchanger 10'.

In one embodiment, a divider (not shown), such as formed from a piece of sheet metal for example, extends inwardly from the first end of the housing 24 along the center line C. The divider may be used to separate the condenser module 22 including the heat exchanger 10 and the fan assembly 40 into a plurality of generally identical modular portions, such as a first portion 46 and a second portion 48 for example. Such configuration may also allow for a more efficient part-load operation.

Operation of the at least one fan 42 associated with the at least one heat exchanger 10 in either the first or second modular portion 46, 48 of the condenser module 22 causes air to flow through an adjacent air inlet and into the housing 24. As the air passes over the heat exchanger 10, heat transfers from the refrigerant inside the heat exchanger 10 to the air, causing the temperature of the air to increase and the temperature of the refrigerant to decrease. If an air inlet into one of the modular portions 46, 48 of the condenser module 22 becomes partially or completely blocked, the at least one fan 42 of that modular portion 46, 48 may be turned off to limit the power consumption and improve the efficiency of the condenser module 22.

By arranging the heat exchanger assembly 32 generally longitudinally between the opposing lateral sides 26, 28 of the housing 24, the number of turns in the flow path of air entering the housing 24 is reduced to a single turn. This new orientation of the heat exchanger assembly 32 also allows for better run off which reduces the likelihood of corrosion and allows for evaporative condensing. In addition, inclusion of generally modular portions 46, 48 within each condenser module 22 provides up to a significant reduction in the system losses in the module 22 as well as in the required fan power. Because the velocity of the air through the housing 24 is more uniform and the overall airflow is increased (due to lower flow losses), the heat transfer capability of the condenser module 22 is improved.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims. In particular, similar principals and ratios may be extended to the rooftops applications and vertical package units.

We claim:

1. An air-cooled chiller system comprising:

a first heat exchanger including:

a first tube bank including at least a first flattened tube segment and a second flattened tube segment extending longitudinally in spaced parallel relationship;

a second tube bank including at least a first flattened tube segment and a second flattened tube segment extending longitudinally in spaced parallel relationship, the second tube bank disposed behind the first tube bank with a leading edge of the second tube bank spaced from a trailing edge of the first tube bank;

a plurality of spaced webs joining the first flattened tube segment of the first tube bank to the first flattened tube segment of the second tube bank, wherein at least one web of the plurality of webs is scored at a score location defining at least one scored web configured to provide a path of least resistance for crack propagation due to different thermal expansion of components of the first heat exchanger; and a fan positioned to direct an airflow over the first tube bank prior to the second tube bank, wherein refrigerant is configured to flow in the first heat exchanger in a cross-counterflow direction opposite that of the airflow direction from the fan.

2. The air-cooled chiller system of claim 1 wherein:

the first heat exchanger has at least three refrigerant passes, wherein at least one refrigerant pass is provided in the second tube bank and at least one refrigerant pass is provided in the first tube bank.

3. The air-cooled chiller system of claim 2 wherein:

a first refrigerant pass is provided in the second tube bank, a second refrigerant pass is provided in the first tube bank and a third refrigerant pass is provided in the first tube bank.

4. The air-cooled chiller system of claim 3 wherein:

the first refrigerant pass corresponds to 50% of the heat exchange area of the first heat exchanger.

5. The air-cooled chiller system of claim 3 wherein:

the second refrigerant pass corresponds to 30% to 40% of the heat exchange area of the first heat exchanger.

6. The air-cooled chiller system of claim 3 wherein:
the third refrigerant pass corresponds to 10% to 20% of the heat exchange area of the first heat exchanger.

7. The air-cooled chiller system of claim 1 further comprising:
a second heat exchanger including:
a first tube bank including at least a first flattened tube segment and a second flattened tube segment extending longitudinally in spaced parallel relationship;
a second tube bank including at least a first flattened tube segment and a second flattened tube segment extending longitudinally in spaced parallel relationship the second tube bank disposed behind the first tube bank with a leading edge of the second tube bank spaced from a trailing edge of the first tube bank.

8. The air-cooled chiller system of claim 7 further comprising:
a housing having a longitudinal axis,
wherein the first heat exchanger and second heat exchanger are positioned in a V configuration in the housing.

9. The air-cooled chiller system of claim 8 wherein:
an axis corresponding to an apex of the V configuration is parallel to the longitudinal axis.

10. The air-cooled chiller system of claim 8 wherein:
an axis corresponding to an apex of the V configuration is perpendicular to the longitudinal axis.

11. The air-cooled chiller system of claim 7 wherein:
the first heat exchanger and second heat exchanger are positioned in a U configuration.

12. The air-cooled chiller system of claim 1 wherein:
the at least one scored web is positioned proximate a distal end of the first flattened tube segment of the first tube bank.

13. The air-cooled chiller system of claim 1 wherein:
the first flattened tube segment of the first tube bank and the first flattened tube segment of the second tube bank are spaced apart by a gap, the width of the gap being 15% to 25% of the distance from a leading edge the first flattened tube segment of the first tube bank to a trailing edge of the first flattened tube segment of the second tube bank.

14. The air-cooled chiller system of claim 1 wherein:
the first flattened tube segment of the first tube bank and the first flattened tube segment of the second tube bank are spaced apart by a gap, the plurality of webs taking up 5% to 10% of space in the gap.

15. The air-cooled chiller system of claim 1 wherein:
a width of one of the first flattened tube segment of the first tube bank and the first flattened tube segment of the second tube bank is 30% to 50% of heat exchanger core depth.

16. The air-cooled chiller system of claim 1 further comprising:
a manifold connected to the first flattened tube segment of the first tube bank, the manifold outer diameter being 1.4 to 2.2 times a width of the first flattened tube segment of the first tube bank.

17. The air-cooled chiller system of claim 1 further comprising:
a folded fin positioned between the first flattened tube segment of the first tube bank and the second flattened tube segment of the first tube bank, a fin density of the folded fin being 19 fins per inch to 22 fins per inch.

18. The air-cooled chiller system of claim 1 further comprising:
a folded fin positioned between the first flattened tube segment of the first tube bank and the second flattened tube segment of the first tube bank, a ratio of fin height to tube pitch the first tube bank being 0.45 to 1.4.

19. The air-cooled chiller system of claim 1 further comprising:
an inlet manifold coupled to the second tube bank; and
at least three refrigerant inlet pipes to supply refrigerant to the inlet manifold.

20. The air-cooled chiller system of claim 19 further comprising:
an outlet manifold coupled to the first tube bank;
the inlet manifold is positioned at a first end of the second tube bank, the outlet manifold positioned at a second end of the first tube bank, the second end being opposite the first end.

21. The air-cooled chiller system of claim 1 wherein:
an airflow rate over the heat exchanger is 300 feet per minute to 700feet per minute.

22. The air-cooled chiller system of claim 21 wherein:
the airflow rate over the heat exchanger is 400 feet per minute to 500 feet per minute.

23. The air-cooled chiller system of claim 1 wherein:
a refrigerant flow rate through the heat exchanger is 2500 pounds per hour to 4500 pounds per hour.

24. The air-cooled chiller system of claim 1 wherein:
the refrigerant is a high pressure refrigerant or a low pressure refrigerant.

25. The air-cooled chiller system of claim 1 further comprising:
a frame surrounding the outer edges of the heat exchanger, the frame comprising a C-shaped channel.

26. An air-cooled chiller system comprising:
a first heat exchanger including:
a first tube bank including at least a first flattened tube segment and a second flattened tube segment extending longitudinally in spaced parallel relationship;
a second tube bank including at least a first flattened tube segment and a second flattened tube segment extending longitudinally in spaced parallel relationship, the second tube bank disposed behind the first tube bank with a leading edge of the second tube bank spaced from a trailing edge of the first tube bank;
a plurality of spaced webs joining the first flattened tube segment of the first tube bank to the first flattened tube segment of the second tube bank, wherein at least one web of the plurality of webs is scored at a score location defining at least one scored web configured to provide a path of least resistance for crack propagation due to different thermal expansion of components of the first heat exchanger;
a second heat exchanger including: a first tube bank including at least a first flattened tube segment and a second flattened tube segment extending longitudinally in spaced parallel relationship; a second tube bank including at least a first flattened tube segment and a second flattened tube segment extending longitudinally in spaced parallel relationship, the second tube bank disposed behind the first tube bank with a leading edge of the second tube bank spaced from a trailing edge of the first tube bank;
the first heat exchanger and second heat exchanger are positioned in a condenser module including:
a housing having a first lateral side that defines a first air inlet and an opposing second lateral side which defines a second air inlet;

the first heat exchanger and second heat exchanger located within the housing;

a fan assembly including a first fan aligned with the first heat exchanger and a second fan aligned with the second heat exchanger;

wherein the condenser module is symmetrical about a center line between the first lateral side and the second lateral side such that the condenser module is formed from an identical first modular portion and second modular portion.

* * * * *